United States Patent [19]

Mailliet et al.

[11] Patent Number: 4,582,302

[45] Date of Patent: Apr. 15, 1986

[54] SUSPENDED TUYERE STOCK REMOVAL DEVICE

[75] Inventors: Pierre Mailliet, Howald; Edgar Kraemer, Hellange, both of Luxembourg

[73] Assignee: Paul Wurth S.A., Luxembourg, Luxembourg

[21] Appl. No.: 637,368

[22] Filed: Dec. 12, 1983

[30] Foreign Application Priority Data

Dec. 10, 1982 [LU] Luxembourg ..... 84522

[51] Int. Cl.[4] ..... F27B 1/16

[52] U.S. Cl. ..... 266/287; 266/265

[58] Field of Search ..... 266/265, 287

[56] References Cited

U.S. PATENT DOCUMENTS

| | | | |
|---|---|---|---|
| 3,459,418 | 8/1969 | Veshima et al. | 266/272 |
| 4,087,084 | 5/1978 | Meyers | 266/287 |
| 4,266,907 | 5/1981 | Mailliet | 414/687 |

FOREIGN PATENT DOCUMENTS

| | | | |
|---|---|---|---|
| 12266 | 6/1980 | European Pat. Off. | 266/265 |
| 428866 | 5/1926 | Fed. Rep. of Germany . | |
| 2314119 | 1/1977 | France . | |
| 49-19964 | 5/1974 | Japan . | |

*Primary Examiner*—Melvyn J. Andrews

*Attorney, Agent, or Firm*—Fishman & Dionne

[57] ABSTRACT

A tuyere stock removal device is presented which is particularly well suited for use in conjunction with those types of shaft furnaces having a hot air, closed circuit pipe line which runs a circular course around the bosh. The tuyere stock removal device is suspended by means of rollers on rails and forms an integrated mechanical unit with the hot air, closed circuit pipe line. The present invention will perform all of the handling operations necessary for the dismantling and reinstallation of the blast nozzle and pipe bend as well as the tuyere and any slanting down pipe associated therewith.

33 Claims, 12 Drawing Figures

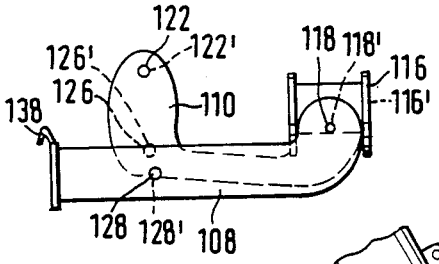
FIG. 3a
FIG. 3
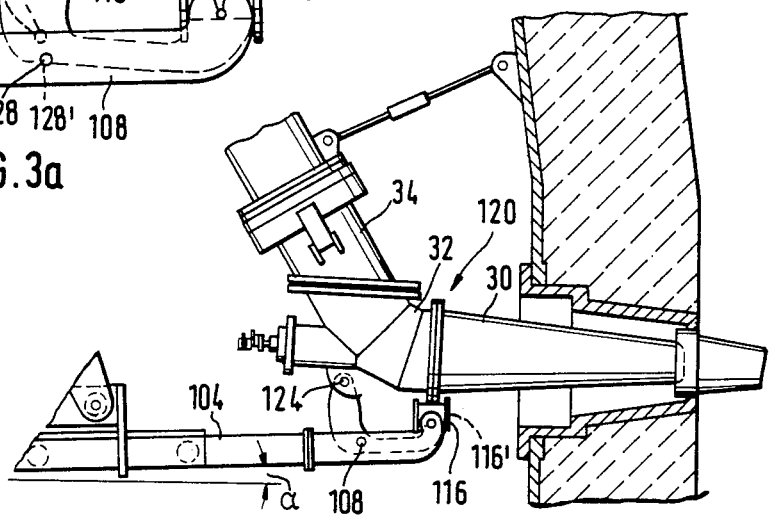
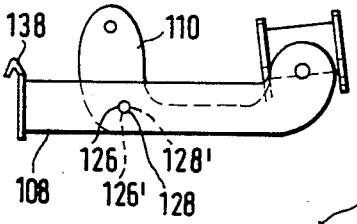
FIG. 4a
FIG. 4
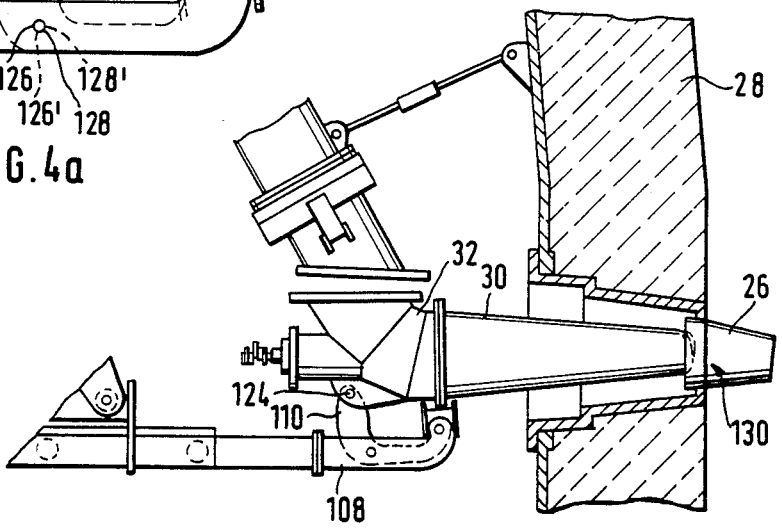

FIG. 5
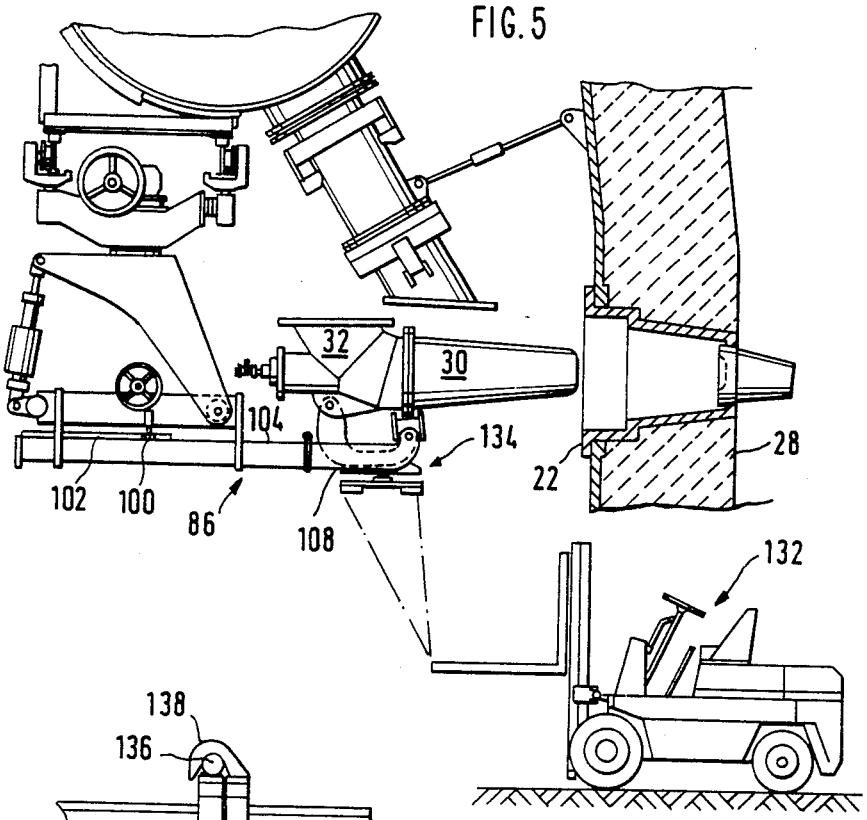
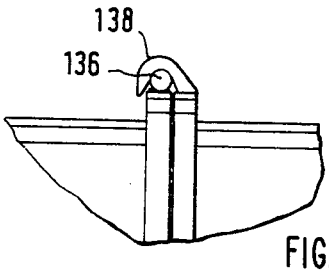
FIG. 5a

SUSPENDED TUYERE STOCK REMOVAL DEVICE

BACKGROUND OF THE INVENTION

This invention relates generally to the field of metallurgical refining in a shaft furnace. More particularly, this invention relates to a new and improved device for removing tuyere stocks from a shaft furnace. The tuyere stock removal device of the present invention is particularly well suited to be used in conjunction with those types of blast furnaces having a hot air, closed circuit pipe line running a circular course around the bosh, the pipe line being concentric to the vertical axis of the furnace. The novel tuyere stock removal device is suspended by means of rollers which are attached to rails, and the device forms an integrated mechanical unit with the hot air, closed circuit pipe line.

As is well known to those skilled in the art, the hearth of a conventional blast furnace is supplied with hot air, which may be enriched with oxygen, via a plurality of tuyeres mounted in the wall of the blast furnace. The hot air is supplied by air heaters which feed a closed circuit pipe line surrounding the blast furnace. Each individual tuyere is then fed from the pipe line via tuyere stocks. These tuyere stocks consist, in part, of a down pipe which slants downwardly from the closed circuit pipe line, a pipe vent is attached to the down pipe, followed by a blast nozzle which forms a horizontal connection between the pipe vent and the tuyere.. The down pipe is usually provided with equipment for compensating any thermal expansion.

The tuyeres extend into the blast furnace and are thereby exposed to a considerable amount of mechanical and thermal stresses and resulting wear. Accordingly, the tuyeres have to replaced relatively frequently. This replacement of the tuyeres, i.e., the dismantling of a defective tuyere and the subsequent installation of a new one, necessitates the temporary removal of at least the blast nozzle and pipe bend of the tuyere stock. In turn, the supply of hot air and thus, the operation of the blast furnace must be halted during this repair operation.

When smaller blast furnaces are involved, the operation of replacing the tuyeres may be carried out manually using only a few tools. It will be understood however, that in accordance with present day requirements, smaller blast furnaces are typically no longer used. Unfortunately, in the more often utilized medium to very large blast furnaces, the equipment size and weight are so great that the tuyere replacement operation and the work associated therewith can only be performed with mechanical equipment.

A device of this type, i.e., a device for the replacement of damaged tuyeres from a blast furnace, will inevitably involve dismantling of at least a part of the tuyere stock. Accordingly, this device will hereinafter be termed a tuyere stock removal device. It will be understood by those skilled in the art that an important consideration in designing a tuyere stock removal device includes optimizing the ratio of labor costs and other expenditures to overall efficiency of blast furnace operation. This optimization will require the reduction of the idle period wherein the blast furnace is not used during the replacement operation of the tuyere.

One attempted prior art solution to the problems associated with the design of an efficient tuyere stock removal device is described in German Patent Application No. 2833303, corresponding to U.S. Pat. No. 4,266,907 assigned to the assignee hereof and incorporated herein by reference. In the system discussed therein, a lifting arm attached to a floor vehicle is provided with suitably designed handling tools. These tools, which are remote controlled by the driver, effect removal of the tuyere stock. It should be understood that this floor vehicle can be have a multi-purpose construction so that during the periods of time in which the removal and replacement of the tuyere is not necessitated, the floor vehicle may be used for other purposes within the plant. As the tuyere removal operation only takes up a small fraction of the vehicles' time, the actual cost of equipment for the removal of the tuyere stock is effectively reduced to a minimum.

Unfortunately, the tuyere stock removal device as disclosed in U.S. Pat. No. 4,266,907 is only suitable for blast furnaces in which there is an uninterrupted platform or stage which surrounds the entire furnace and is disposed beneath the hot air closed circuit pipe line and the tuyere stocks. It is well known that an uninterrupted platform of this type is only found in very large modern blast furnaces. However, in other blast furnaces, because of the lack of sufficient height, the platform is interrupted above the tapholes in order to have space available for the insertion of the taphole bores and guns. Accordingly, the above discussed floor vehicles cannot remove the tuyere stocks which are situated above the gaps in the platform. As a direct consequence thereof, the tuyere stock removal device as described in U.S. Pat. No. 4,266,907 is not suitable for these types of blast furnaces, i.e., the small to medium blast furnaces.

Since, the tuyere stocks are spaced around the entire periphery of the blast furnace, and the hot air closed circuit pipe line extends around the entire periphery of the blast furnace, it has been suggested, that a tuyere stock removal device be provided which is capable of travelling along rails suspended on the pipe line. This would permit even those tuyere stocks which are located above the gaps in the platform to be serviced by the suspended tuyere stock removal device.

Suspended tuyere stock removal devices of this type have been constructed, but, unfortunately, have proven to be extremely expensive if they are to perform all of the operations to which the present invention is directed. These operations, of course, consist of dismantling the blast nozzle with its bend pipe, removal of the tuyere, and possibly dismantling the slanting down pipe. The large number of electrical and/or operating motors and their associated conductors or power supply units in these prior systems create, in part, the great expense of these devices.

Contrary to the multi-purpose floor vehicle discussed above, a suspended tuyere removal device of the type just discussed can only be used for dismantling or removing the tuyere stocks. Thus, in comparison to the floor vehicle system, the labor intensive and costly operation of installing a suspended tuyere removal device seriously detracts from the favorable features associated therewith. Moreover, since present suspended tuyere removal devices consist of a relatively complicated structure, the increase of breakdowns and problems associated with this complex structure provides a greater chance for equipment failure and therefore higher costs.

In order to construct transportable tuyere stock removal devices suspended on the hot air closed circuit pipe lines in a more practical and efficient manner, various suggestions and proposals have been made which would permit the taphole borers and/or guns to also be suspended on a tuyere stock removal device of this type. This would allow the borers and/or guns to freely move about the periphery of the furnace. This design, however, necessitates that the conventional infrastructure of the lower zone of the blast furnace be extensively altered. Accordingly, this type of suspended tuyere stock removal device cannot be used in an existing blast furnace. Moreover, the complexity of such a device would create additional cost problems.

SUMMARY OF THE INVENTION

The above discussed and other problems of the prior art are overcome or alleviated by the suspended tuyere stock removal device of the present invention. In accordance with the present invention, a novel tuyere stock removal device is provided having only a minimum number of structural components thereby ensuring operational reliability and economy. The suspended removal device of the present invention will perform all of the handling operations necessary for the dismantling and reinstallation of the blast nozzle and pipe bend as well as the tuyere and any slanting down pipe associated therewith.

The tuyere stock removal device of the present invention is particularly well suited for use in conjunction with those types of blast furnaces having a hot-air, closed circuit pipe line which runs a circular course around the bosh, the pipe line being concentric to the vertical axis of the furnace. The device of the present invention is suspended by means of rollers on rails and forms an integrated mechanical unit with the hot air, closed circuit pipe line.

The tuyere stock removal device of the present invention is comprised of a carriage having two pivotally connected sections, each section having a pair of running rollers which act to transport the carriage along the rails. First chain pulls associated with gearing are provided for driving or actuating the running rollers.

A pivotal support means is suspended from the carriage in such a way as to be pivotable about a vertical axis. The pivotal support has two substantially horizontal arms and two vertically slanted arms, each arm being provided with apertures at the ends thereof. A second chain pull and associated gearing acts to move the pivotal support about the vertical axis at an appropriate point during the tuyere stock removal.

A supporting frame essentially comprised of two parts, including an upper portion and a lower portion, is rigidly interconnected by means of suitably shaped steel plates. The upper portion of the supporting frame is connected to the slanting arms of the pivotal support at appropriate points. A double acting hydraulic cylinder is connected between the horizontal arms of the pivotal support (at different points) and the upper portion of the support frame. The cylinder acts to pivot the upper and lower portions of the supporting frame about a horizontal axis.

The lower portion of the supporting frame has attached thereto a mounting carriage with rollers which are capable of horizontal displacement along two, preferably U-section rails. A toothed rack, parallel to the rails, is located on the mounting carriage. A worm gearing is fixed to the upper portion of the supporting frame and has a horizontal input shaft and a substantially vertical output shaft. The input shaft is driven via a hand wheel and the output shaft is actuated by a pinion which engages the toothed rack so that when the hand wheel is operated, the mounting carriage is horizontally displaced along the rails. Finally, an overhanging arm extending from the mounting carriage is provided with an end section. Assorted mounting and dismantling tools for the tuyere stock can then be easily fixed to the end portion for disassembly, removal, replacement and/or reassembly of the tuyere stock and tuyere in accordance with the present invention.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures:

FIG. 3 is a side elevation view, partly in cross-section, showing the manner in which the tuyere stock pipe bend with blast nozzle is affixed to an overhanging arm of the tuyere stock removal device during a first phase of operation in dismantling the tuyere stock and in accordance with the present invention.

FIG. 3*a* is a side elevation view of an enlarged portion of the tuyere stock removal device of FIG. 3.

FIG. 4 is a side elevation view, partly in cross-section, showing the manner in which the pipe bend and blast nozzle are mounted on the overhanging arm of the tuyere stock removal device in a second phase of the dismantling operation of the tuyere stock in accordance with the present invention.

FIG. 4*a* is a side elevation view of an enlarged portion of the tuyere stock removal device of FIG. 4.

FIG. 5 is a side elevation, partially schematic view of a third phase of the dismantling operation of the tuyere stock using the tuyere stock removal device of the present invention.

FIG. 5*a* is a side elevation view of an enlarged portion of FIG. 5.

DESCRIPTION OF THE PREFERRED EMBODIMENT

Figure 1:
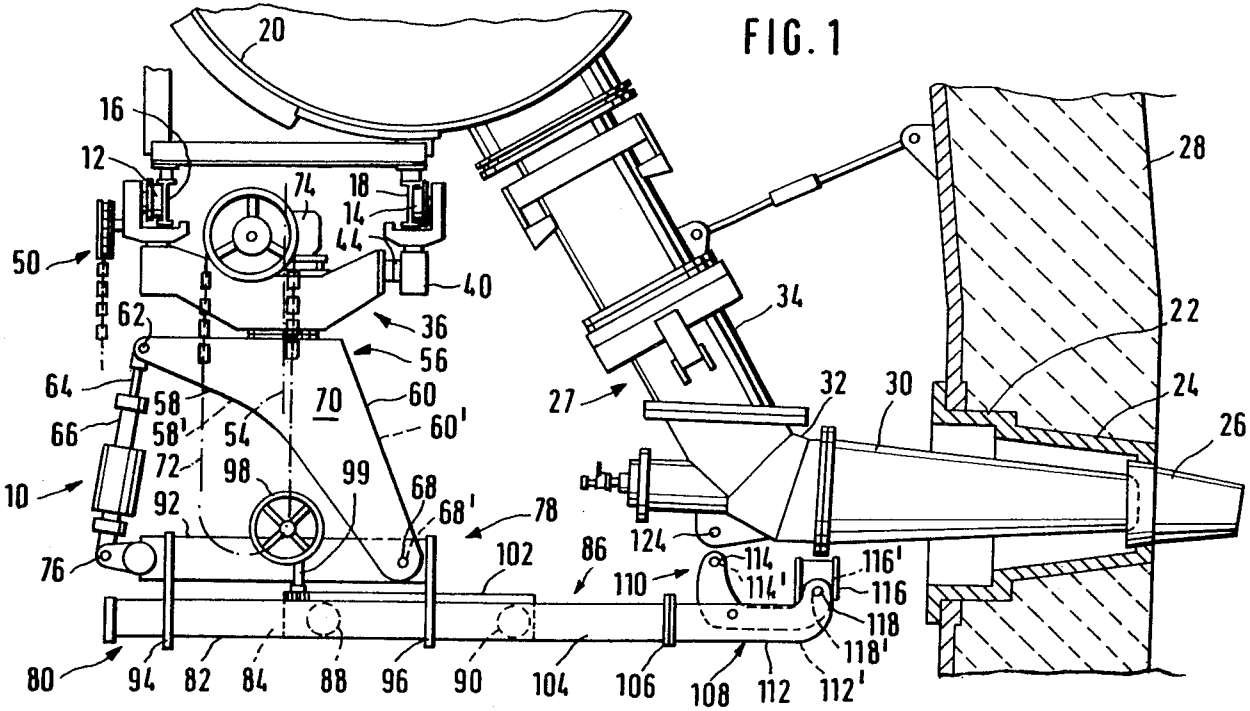
FIG. 1 is a side elevation view, partly in cross-section, of a suspended tuyere stock removal device in accordance with the present invention.
Figure 2:
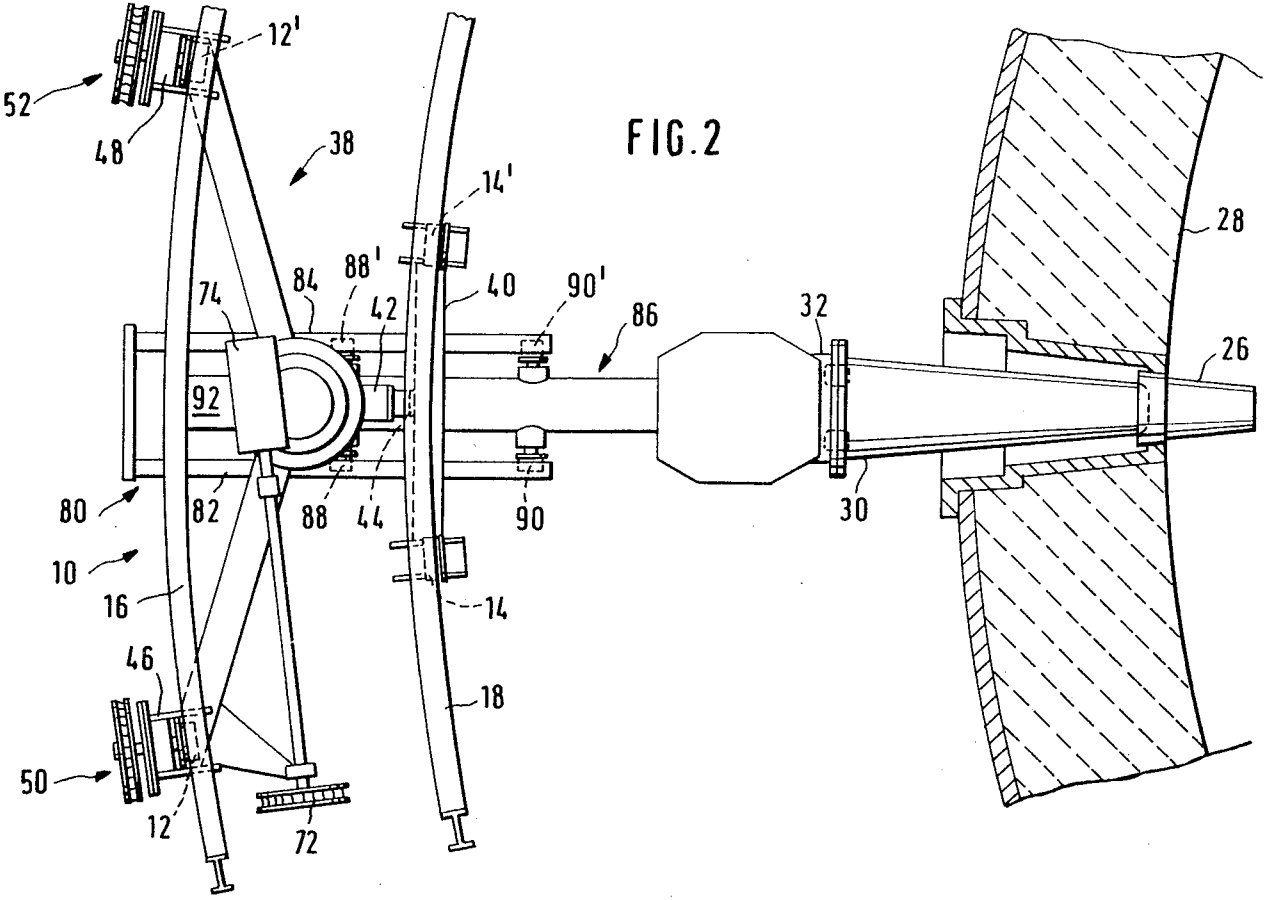
FIG. 2 is a plan view of the tuyere stock removal device of FIG. 1, with the closed circuit pipe and other elements omitted for convenience of viewing.

Referring first to FIGS. 1 and 2, a suspended tuyere stock removal device in accordance with the present invention is shown generally at 10. The stock removal device 10 is suspended by outer rollers 12, 12' and inner rollers 14, 14' from rails 16 and 18 respectively. These rails, in turn, are secured to a hot air closed circuit pipe line 20 of a furnace; this pipe line 20 being shown only in part and in section. The rails 16 and 18 preferably have configurations consisting of an I or U cross section. In FIGS. 1 and 2, a portion of the blast furnace wall 28 having a tuyere block 22, a cooling ring 24 and a tuyere 26 therein is shown. The tuyere 26 is connected at its upstream end to a tuyere stock 27. Tuyere stock 27 essentially consists of a blast nozzle 30 having a pipe bend 32 and a slanting down pipe 34, all for air flow therethrough. Slanting down pipe 34 is connected to the closed circuit pipe line 20.

Rollers 12, 12' and 14, 14' act as the running rollers for a carriage 36 and are the means by which the tuyere removal device 10 is moved into position in front of the tuyere stock 27 for the dismantling thereof. The frame of carriage 36 is comprised of two component portions including a first portion 38 which is Y-shaped in a plan view (see FIG. 2) having attached thereto running rollers 12 and 12', and a straight horizontal connecting beam 40 which is situated between and attached to the rollers 14 and 14'. The leg 42 of the Y-shaped portion 38 is fixed via a pivot bearing 44 to the middle of the connecting beam 40 so that the load prevailing at that point is evenly distributed over the rollers 14, 14'.

Carriage 36 is moved along the rails 16 and 18 by acuation self-locking gearings 46 and 48. These gearings apply force to the outer rollers 12, 12' and/or the inner rollers 14, 14', and may be operated manually by means of chain pulls 50, 52.

A yoke 56 having two pairs of arms 58, 58' and 60, 60' extending therefrom, is attached to and pivotable about a vertical shaft 54 on the carriage 36. Note that the arms 58 and 60 are identically similar to the arms 58' and 60' (not shown). The arms 58, 58' have a horizontal configuration and an aperture 62 at one end which receives a piston rod 64 of a double acting hydraulic cylinder 66. The arms 60, 60' have a downward or vertical slant to the right, as shown in FIG. 1, with apertures 68 and 68' at the respective ends thereof. The yoke 56 with arms 58, 58' and 60, 60' will be hereinafter referred to as the pivotal support 70. Pivotal support 70 is similarly actuated, i.e., pivoted about the vertical shaft 54, by means of the chain pull 72 and a self-locking worm gear 74. The presence of a self-locking work gear 74 is extremely important in that a load may generate an undesirable torque about the axis 54 if the latter is not exactly in the vertical direction. This nonvertical orientation may easily result from inaccuracies during assembly, warping of the closed circuit pipe line, etc.

A supporting frame 78 pivotally connected to pivotal support 70 at apertures 66, 68' and is suspended at one end by a hinge 76 connected to the hydraulic cylinder 66. The lower portion 80 of the supporting frame 78 essentially consists of two rails 82 and 84, preferably of U section, along which a mounting carriage 86 can move in the horizontal direction on rollers 88, 88' and 90, 90' as shown in FIG. 2. It will be understood that the body of the mounting carriage 86 preferably has a tubular shape also as shown in FIG. 2. The upper portion 92 of the supporting frame 78 is similarly preferably tubular in shape. The upper portion 92 and the lower portion 80 of frame 78 are rigidly connected to each other by suitably shaped steel plates 94 and 96.

As with many of the previously discussed components, the movement or displacement of the mounting carriage 86 is effected by a manually operated, self-locking gearing (not shown). The gearing works in conjunction with a driving wheel 98 and a rack drive with pinion 99 located on the output shaft of the worm gearing fixed to the upper portion 92. Also, a rack 102 (of which the teeth are not shown) on the mounting carriage 86 is utilized in providing movement to the carriage 86. As in the previously discussed gearing applications, this locking gearing serves to prevent the forces caused by the load from affecting the desired direction of travel of the mounting carriage 86. Forces of this type are generated when, for example, the supporting frame 78 and the mounting carriage 86 are pivoted at the aperture point 68, 68' out of the horizontal by actuating the hydraulic cylinder 66.

The hydraulic cylinder 66 having pivot connectors 62 and 76 on the pivotal support 70 and the upper portion 92 of the support frame 78, respectively, operates to pivot frame 78 about the points 68, 68'. The cylinder 66 is of the double acting type and may be actuated manually by a hand pump (not shown). This hand pump is analogous to a conventional lifting jack or the like. Preferably, the cylinder 66 is combined with a hand pump, an oil tank and valves to form a compact unit. In the alternative, the operation of the hydraulic cylinder 66 may be simplified by use of either an electrically or pneumatically operated hydraulic power unit.

The tubular body of the mounting carriage 86 is extended toward the direction of the wall 28 of the blast furnace by an arm 104. The end 106 of arm 104 has a flange configuration so that the tools suitable for the removal (and insertion) of the tuyere stock can be affixed thereto. In FIG. 1, this tool consists of a supporting frame or member 108 in which a supporting stool 110 for the blast nozzle 30 and pipe bend 32 can be mounted thereon. The supporting frame or member 108 may consist of, for example, two L-shaped flat steel bars 112, 112', which may be fixed to the end 106 of the arm 104, by any suitable connection, such as by a cotter pin connection which is well known (and not shown).

The supporting stool 110 is a simplified version of a similar stool which is described in detail in German Patent Application No. 2833303 discussed above. The simplified stool 110 is well suited and adapted for the tuyere stock removal device of the present invention. This stool 110 is cradle shaped as shown in FIG. 1, and essentially consists of two side portions, such as cradle shaped flat steel bars 114 and 114' which are connected by trusses (not shown). The trusses have thereon two rotatably mounted rollers 116, 116' on the furnace side thereof. Details for a method of mounting the rollers 116, 116' on the supporting stool 110 is described in detail in the aforementioned German patent application which is incorporated herein by reference thereto. The supporting stool 110 may be pivotably connected to supporting frame 108 by fulcrums 118 and 118'. This pivotable connection to the supporting frame 108 may be deferred until the tuyere stock is about to be removed, in which case, the supporting stool 110 may be connected thereto by means of, for example, a cotter pin through 118 and 118'. When using a cotter pin connection, the supporting frame 108 may serve not only to accommodate the stool 110, but also, after the stool is removed, to accommodate other tools used for dismantling or removing purposes.

Referring now to FIGS. 3, 4 and 5, successive steps in the dismantling process of the blast nozzle 30 and pipe bend 32 from the tuyere 26 is shown. In FIG. 3, the arm 104 is pivoted or angled upwardly out of the horizontal by operation of the cylinder 66 (shown in FIG. 1) until the rollers 116, 116' come to rest on the securing flange 120 of the blast nozzle 30 and pipe bend 32. At this point, the stool 110 is connected to the supporting frame 108 by the fulcrums 118, 118' (such as by means of cotters as shown in FIG. 3*a*). Simultaneously or immediately thereafter, the stool 110 is manually pivoted upwardly about the fulcrums 118, 118' until the borings 122, 122' in the stool 110 are aligned with a lug 124 on the pipe bend 32. Subsequently, the stool 110 and the pipe bend 32 (with the blast nozzle 30 attached thereto) are connected to each other at the lug 124 by the insertion of a cotter pin or the like. The stool 110 then assumes, in relation to the arm 108, the position shown in FIG. 3*a*, i.e., that position in which the borings 126, 126' in the stool are located above borings 128, 128' in the supporting frame 108.

The next phase in removing the tuyere stock is the release of the screw connection (not shown) between the flanges of the down pipe 34 and the pipe bend 32. The arm 104 is then lowered by operating the cylinder 66 accordingly so that the mouthpiece of the blast nozzle will rest against the tuyere 26 at the point identified at 130. This will cause the pipe bend 32 to move downwardly as shown in FIG. 4. As this process is taking place, the borings 126, 126' in the stool 110 will align with the borings 128, 128' in the supporting frame 108 so that the stool 110 and supporting frame 108 can be interconnected at these borings by a cotter pin or the like. The stool 110 and suppporting frame 108 will then assume the relative position which is shown in FIGS. 4 and 4*a*. The pipe bend 32 is then connected to the stool 110 at the aperture 124, while the stool 110 is in turn, connected to the supporting frame 108 at the points 128 and 118. As is shown in FIG. 4, the weight of the pipe bend 32 and blast nozzle 30 is greater toward the right of the securing point 124 than the weight to the left thereof. Accordingly, the nozzle and bend pipe are in a stable equilibrium resting on rollers 116, 116', and the nozzle and pipe bend can now be withdrawn from the tuyere 26 and from the wall 28 of the furnace without risk. This final withdrawal is accomplished by actuating the rack and pinion gearing 100, 102.

FIG. 5 shows the position of the mounting carriage 86 and the pipe bend 32 with blast nozzle 30 after the removal thereof from the wall 28 and the tuyere 26. The supporting frame 108 with the tuyere stock parts mounted thereon can now be removed by a stacker truck 132 or a similar vehicle as schematically shown in FIG. 5. Preferably, a bogie pallet 134 is utilized for this removal purpose. It will be obvious to one skilled in the art that due to the size of the furnace wall 28, the stacker truck 132 cannot actually assume the position schematically illustrated in FIG. 5, just as the blast nozzle 30 will not necessarily occupy the position shown in front of the tuyere block 22 when the supporting frame 108 is lifted up by the stacker truck 132. In fact, the load to be transferred to the stacker truck 132 may be moved to any desired point underneath the closed circuit pipe line 20 by the movement of the carriage 36 and can thereafter be pivoted about the vertical axis 54 into any desired position by operating the chain pull 72. Accordingly, there is a great deal of freedom in chosing the particular point at which the load is transferred to the stacker truck 132, even if the movement of the carriage 36 along the rails 16 and 18 will normally be kept to a minimum. In those situations wherein there is a break in the track underneath the tuyere stock which is to be removed, the load may have to be transported along the rails 16 and 18 to a point where the track is intact. The separation of the supporting frame 108 from the mounting carriage 86 may be simplified by suspending frame 108 from the arm 104 of the mounting carriage 86 instead of connecting the supporting frame and the arm to each other by a cotter connection or similar device. A connection system of the suspension type, will typically use a pin 136 and a hook 138 as schematically shown in FIGS. 5 and 5*a* (this suspension type connection is also indicated in FIGS. 3*a* and 4*a*).

Figure 6:
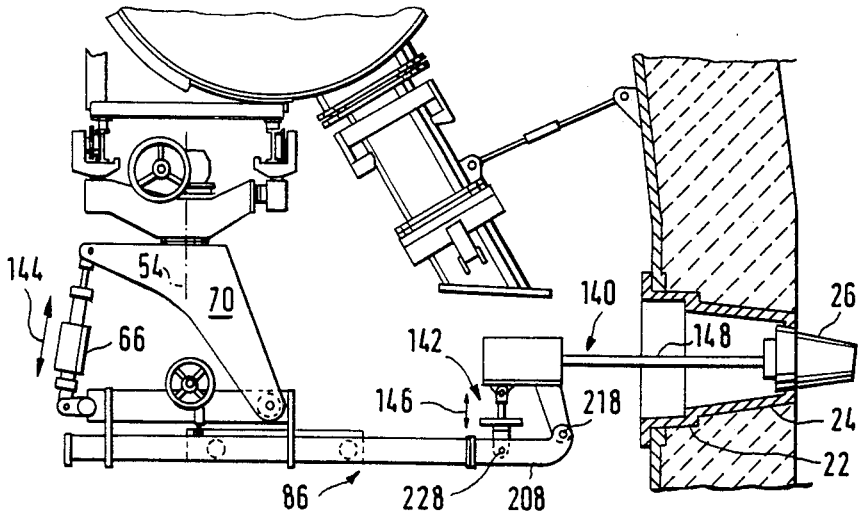
FIG. 6 is a side elevation view, partly in cross-section, showing the first step in the operation of dismantling the tuyere in accordance with the present invention.
Figure 7:
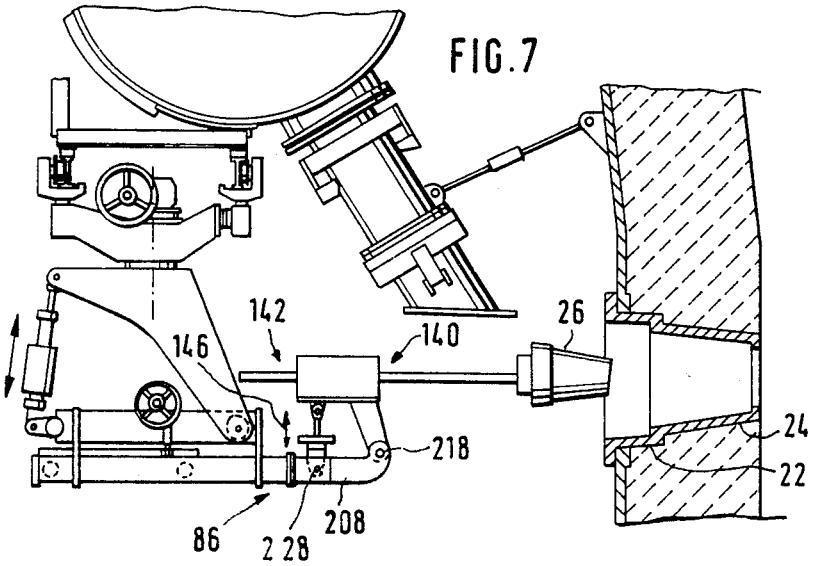
FIG. 7 is a side elevation view, partly in cross-section, showing a second step in the operation of dismantling the tuyere in accordance with the present invention.

Referring now to FIGS. 6 and 7, a method and apparatus for removing the tuyere 26 from the wall 28 is shown, it being understood that the removal of the tuyere 26 may also be effected by the tuyere stock removal device of the present invention. A tuyere removal device 140 which is well known in the art is mounted on a supporting frame 208, supporting frame 208 being identical to the supporting frame 108 discussed earlier. The device 140 is connected to the frame 208 by pins at apertures 218 and 228 provided in the supporting frame 208 and corresponding to the borings 118 and 128 in FIG. 3*a*. In FIG. 6, the extraction device 140 is hinged to the supporting frame 208 at the aperture 218 and is also connected by cotter pins through the boring 228 having an adjusting spindle 142 positioned therebetween. By moving the mounting carriage 86 and actuating the cylinder 66 and adjusting spindle 142, (arrows 144 and 146 respectively) the extraction bar 148 can be adjusted to any desired position in relation to the tuyere 26. The removal of the tuyere 26 and any necessary support (not shown) located between the extraction device 140 and the cooling ring 24 which prevent the latter from working loose in the wall of the blast furnace (in the tuyere block 22) are described in greater detail in the German Patent Application No. 2833303.

In FIG. 7, the tuyere 26 is shown after it has been removed from the wall of the furnace. The tuyere 26 may now be placed onto a stool provided on the working platform and replaced with a new tuyere which can be installed back into the wall of the furnace. Note that the supporting frame 208 with the removable device 140 and tuyere 26 thereon may also be lifted up and removed by a stacker truck as was similarly shown in conjunction with in FIG. 5. As discussed earlier, the stacker truck may receive the load at almost any desired point in the zone underneath the closed circuit pipe line 20.

Figure 8:
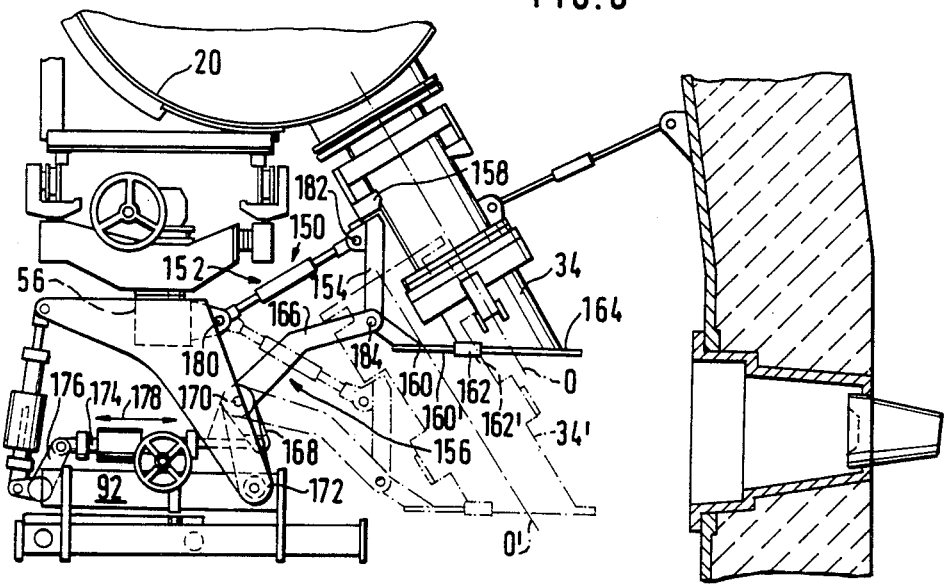
FIG. 8 is a side elevation view, partly in cross section, showing the dismantling operation of the slanting down pipe by the tuyere stock removal device and an adaptor in accordance with the present invention.

Referring now to FIG. 8, the operation of dismantling the slanting down pipe 34 of the tuyere stock 27 is shown. For this particular operation, the tuyere stock removal device can be provided with an adapator 150 which essentially consists of a longitudinally adjustable strut 152 (having a configuration similar to that of a turnbuckle), a bearing and support arm 154 and an operating lever 156. One end of the strut 152 is pivotally connected at 180 to an overhanging arm of the pivotable yoke 56 and the other end is pivotally connected at 182 to the top of the bearing and support arm 154. At the upper end of the bearing and support arm 154 is a bolt (not shown) which is capable of engaging a boring (not shown) which is provided in the upper flange 158 of the down pipe 154. The lower part of the bearing and support arm 154 is provided with horizontal extensions 160, 160' having supporting blades 162, 162' on the respective sides thereof. The lower flange 164 of the down pipe 34 can then come to rest against the supporting blades 162, 162' as the down pipe is being dismantled. It should be understood that the bearing and support arm 154 has a structure which is similar to an analogous arm described in the aforementioned German Patent Application and can be referred to for further details thereof. The operating lever 156 is a double armed lever having arms 166 and 168 thereon. The fulcrum 170 of this double armed lever 156 is located on and corresponds to a mounting system on a first overhanging arm 172 which is rigidly mounted to the upper portion 92 of the supporting frame 78 (see also FIG. 1). The outer end of arm 166 of operating lever 156 is hingedly connected to the bearing and support arm 154 at 184 while the lower end of arm 168 is hingedly connected to the end of the piston rod of an operating cylinder 174, the oeprating cylinder being manually actuated. Similarly to the hydraulic cylinder 66, the operating cylinder 174 can also be operated by an electrically or pneumatically actuated hydraulic power apparatus if desired. The cylinder side of operating cylinder 174 is hingedly connected to a second overhanging arm 176 of which one end is rigidly connected to the upper portion 92. If the piston of the cylinder 174 is moved inwardly, i.e., toward the left in the direction shown by the arrow 178 in FIG. 8, the down pipe 34 (after being disconnected from pipe 20) will be lowered into the position 34' shown by the broken lines. Note that as the pivot points 170, 180, 182 and 184 of the levers 156 and 166 form the corners of a parallelogram (see FIG. 9), the descent of the down pipe 34 will actually correspond to a thrusting movement, the axis 0 of the down pipe 34 thereby retaining its direction in the course of this descent.

Figure 9:
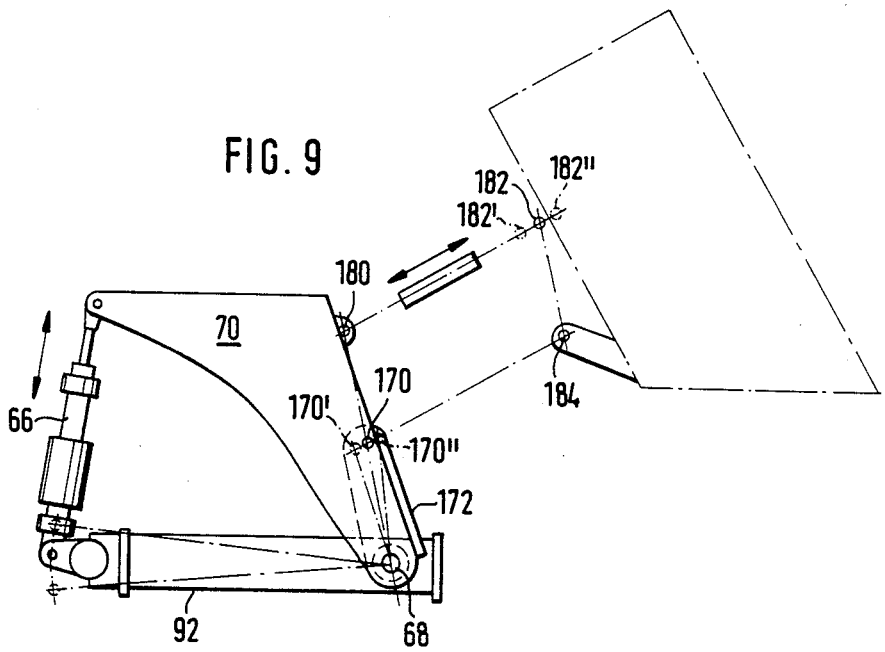
FIG. 9 is a side elevation view of an enlarged portion of the tuyere stock removal device shown in FIG. 8 and in accordance with the present invention.

Still referring to FIG. 9, because the longitudinal adjustability of the struts 152, i.e., by means of the nut and spindles with right-hand and left-hand thread thereon, the upper corner 182 of the schematically drawn parallelogram can be displaced between the positions 182' and 182''. This displacement will more easily allow the introduction of the bolt on the arm 154 into the hole in the flange portion 158. Similarly, the pivot point 170 of the lever 156, on the first overhanging arm 172, which is rigidly connected to the upper portion 92, can also be displaced between the positions 170' and 170'' by pivoting the upper portion 92 about its point of rotation 68 on the pivotal support 70 with the aid of the cylinder 66. The supporting plates 162 and 162' can therefore rest against the flange 164 of the downpipe 34 before the downpipe is detached from the closed circuit pipe line 20.

While it is true that the aforementioned displacement of the points 182 and 170 will cause a certain deformation of the parallelogram (the axis 0 of the down pipe 34 will not retain exactly the same direction during the descending movement), this will not detract from the practical performance of the present invention.

As will be understood to those skilled in the art, the tuyere stock removal device of the present invention may also be used for the reinstallation of the various component parts of the tuyere stock. Accordingly, the above described processes in handling the apparatus will be identical, but in a reverse order.

It will also be understood that numerous modifications can be made to particular details of the tuyere stock removal device of the present invention without departing from the scope and spirit of the invention. For example, the mounting carriage 86 may be extended towards the left by means of an overhanging arm similar to the overhanging arm 104 which extends towards the right. This would make it possible for the tuyere extraction device 140 to remain permanently mounted on the second overhanging arm which points toward the left when the pipe bend 32 and the blast nozzle 30 are being removed. The only operation required in order to dismantle the tuyere 26 would then be to rotate the pivotal support 70 through an angle of 180° about the vertical axis 34 whereby the removal apparatus 140 could likewise be moved into the position shown in FIGS. 6 and 7.

As is clearly seen from the foregoing detailed description, the tuyere stock removal device of the present invention performs all the necessary functions for the extraction or removal and installation of all parts and components of the tuyere stock including the tuyere. Note that these functions are performed despite the simple and economical construction of the present invention. It should be understood that the manual operation of the present invention by means of self-locking gearings and hydraulic cylinders will enable the handling tools to be positioned in a rapid, accurate and safe manner during the removal of particular component parts. Prior art methods and devices have heretofore required far more labor costs, labor time and expense in achieving the same or lesser results.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A tuyere stock removal apparatus for use in conjunction with a blast furnace having a hot air, closed circuit pipe line around the bosh, the tuyere stock comprising at least a blast nozzle, a pipe bend and a slanting down pipe, the removal apoaratus including:

carriage means;

suspension means for suspending said carriage means along first rails, said first rails having a path corresponding to said pipe line;

first driving means for moving said carriage means along said rollers, said first driving means comprising at least one first chain pull associated with at least one reducing gearing;

pivotal support means suspended from carriage means, said pivotal support means capable of pivoting about a vertical axis;

second driving means capable of moving said pivotal support means about said vertical axis;

support frame means being suspended from said pivotal support means;

first pivoting means connected between said support frame means and said pivotal support means whereby said support frame means is capable of pivoting about a horizontal axis;

mounting carriage means attached to said support frame means, said mounting carriage being capable of horizontal displacement;

third driving means for moving said mounting carriage means; and extension arm means attached to said mounting carriage means, said extension arm having an end portion being, said end portion being capable of receiving removable tool means.

2. The apparatus of claim 1 wherein said carriage means comprises a pair of component portions including:

a first carriage portion and a second carriage portion, each of said carriage portions being suspended from said suspension means.

3. The apparatus of claim 2 wherein:

said first carriage portion is Y-shaped.

4. The apparatus of claim 2 wherein:

said second carriage portion is a straight member.

5. The apparatus of claim 3 wherein:

said second carriage portion is a straight member, said Y-shaped first portion being attached to the middle of said second carriage portion.

6. The apparatus of claim 1 wherein said suspension means comprises:

rollers, said rollers capable of moving along said first rails.

7. The apparatus of claim 1 wherein said second driving means comprises:

at least one second chain pull associated with at least one worm gearing.

8. The apparatus of claim 1 wherein:

said mounting carriage is tubular.

9. The apparatus of claim 1 wherein:

said attachment between said mounting carriage means and lower portion of said supporting member includes at least one pin on the mounting carriage means lower portion, said pin being capable of removable connection with at least one hook on said supporting member.

10. The apparatus of claim 9 including:

an overhanging arm attached to said lower portion of said mounting carriage means, said pin being attached thereto.

11. The apparatus of claim 1 wherein:

said removal tool means is a tuyere removal device.

12. The apparatus of claim 11 including:

an adjusting spindle positioned between said supporting member and said tuyere removal device whereby said tuyere removal device is capable of pivoting about a horizontal axis on said supporting member.

13. A tuyere stock removal apparatus for use in conjunction with a blast furnace having a hot air, closed circuit pipe line around the bosh, the tuyere stock comprising at least a blast nozzle, a pipe bend and a slanting down pipe, the removal apparatus including:

carriage means;

suspension means for suspending said carriage means along first rails, said first rails having a path corresponding to said pipe line;

first driving means for moving said carriage means along said rollers;

pivotal support means suspended from said carriage means, said pivotal support means capable of pivoting about a vertical axis, said pivotal support means comprising at least one substantially horizontal arm and at least one substantially slanted arm;

second driving means capable of moving said pivotal support means about said vertical axis;

support frame means being suspended from said pivotal support means;

first pivoting means connected between said support frame means and said pivotal support means whereby said support frame means is capable of pivoting about a horizontal axis;

mounting carriage means attached to said support frame means, said mounting carriage being capable of horizontal displacement;

third driving means for moving said mounting carriage means; and extension arm means attached to said mounting carriage means, said extension arm having an end portion being, said end portion being capable of receiving removable tool means.

14. The apparatus of claim 13 wherein:

said horizontal arm includes at least a first aperture.

15. The apparatus of claim 13 wherein:

said slanted arm includes at least a second aperture.

16. The apparatus of claim 14 wherein:

said slanted arm includes at least a second aperture.

17. The apparatus of claim 16 wherein:

said upper portion of said supporting frame is suspended from said second aperture in said slanted arm.

18. The apparatus of claim 16 wherein:

said first pivoting means is attached to said first aperture in said horizontal arm.

19. A tuyere stock removal apparatus for use in conjunction with a blast furnace having hot air, closed circuit pipe line around the bosh, the tuyere stoch comprising at least a blast nozzle, a pipe bend and a slanting down pipe, the removal apparatus including:

carraige means;

suspension means for suspending said carriage means along first rails, said first rails having a path corresponding to said pipe line;

first driving means for moving said carriage means along said rollers;

pivotal support means suspended from said carriage means, said pivotal support means capable of pivoting about a vertical axis;

second driving means capable of moving said pivotal support about said vertical axis;

support frame means being suspended from said pivotal support means, said support frame means including upper and lower portions, said upper and lower portions being interconnected by a suitably shaped metal plate;

first pivoting means connected between said support frame means and said pivotal support means whereby said support frame means is capable of pivoting about a horizontal axis;

mounting carriage means attached to said support frame means, said mounting carriage being capable of horizontal displacement;

third driving means for moving said mounting carriage means; and extension arm means attached to said mounting carriage means, said extension arm having an end portion being, said end portion being capable of receiving removable tool means.

20. A tuyere stock removal apparatus for use in conjunctions with a blast furnace having a hot air, closed circuit pipe line around the bosh, the tuyere stock comprising at least a blast nozzle, a pipe bend and a slanting down pipe, the removal apparatus including:

carriage means;

suspension means for suspending said carriage means along first rails, said first rails having a path corresponding to said pipe line;

first driving means for moving said carriage means along said rollers;

pivotal support means suspended from said carriage means, said pivotal support means capable of pivoting about a vertical axis;

second driving means capable of moving said pivotal support about said vertical axis;

support frame means being suspended from said pivotal support means;

first pivoting means connected between said support frame means and said pivotal support means whereby said support frame means is capable of pivoting about a horizontal axis, said first pivoting means comprising a double acting hydraulic cylinder;

mounting carriage means attached to said support frame means, said mounting carriage being capable of horizontal displacement;

third driving means for moving said mounting carriage means; and extension arm means attached to said mounting carriage means, said extension arm having an end portion being, said end portion being capable of receiving removable tool means.

21. A tuyere stock removal apparatus for use in conjunction with a balst furnace having a hot air, closed circuit pipe line around the bosh, the tuyere stock comprising at least a blast nozzle, a pipe bend and a slanting down pipe, the removal apparatus including:

carriage means;

suspension means for suspending said carriage means along first rails, said first rails having a path corresponding to said pipe line;

first driving means for moving said carriage means along said rollers;

pivotal support means suspended from said carriage means, said pivotal support means capable of pivoting about a vertical axis;

second driving means capable of moving said pivotal support about said vertical axis;

support frame means being suspended from said pivotal support means;

first pivoting means connected between said support frame means and said pivotal support means whereby said support frame means is capable of pivoting about a horizontal axis;

mounting carriage means attached to said support frame means, said mounting carriage being capable of horizontal displacement;

third driving means for moving said mounting carriage means; and extension arm means attached to said mounting carriage means, said extension arm having an end portion being, said end portion being capable of receiving removal tool means;

wherein said third driving means includes;

a toothed rack, said rack being fixed to said mounting carraige means;

gearing means fixed to said supporting frame means, said gearing having a horizontal input shaft and a substantially vertical output shaft, said output shaft having a pinion which engages said toothed rack; and a wheel means capable of driving said input shaft thereby actuating said pinion on said output shaft whereby said toothed rack being fixed to said carriage means moves relative to said supporting frame means.

22. The apparatus of claim 20 including:

a hand pump used for actuating said hydraulic cylinder.

23. A tuyere stock removal apparatus for use in conjunction witha blast furnace having a hot air, closed circuit pipe line around the bosh, the tuyere stock comprising at least a blast nozzle, a pipe bend and a slating down pine, the removal appartus including:

carriage means;

suspension means for suspending said carriage means along first rails, said first rails having a path corresponding to said pipe line;

first driving means for moving said carriage means along said rollers;

pivotal support means suspended from said carriage means, said pivotal support means capable of pivoting about a vertical axis;

second driving means capable of moving said pivotal support about said vertical axis;

support frame means being suspended from said pivotal support means;

first pivoting means connected between said support frame means and said pivotal support means whereby said support frame means is capable of pivoting about a horizontal axis;

mounting carriage means attached to said support frame means, said mounting carriage being capable of horizontal displacement;

third driving means for moving said mounting carriage means;

extension arm means attached to said mounting carriage means, said extension arm having an end portion being, said end portion being capable of receiving removal tool means; and a supporting member removably attached to said end portion, said supporting member comprising two metal bars.

24. The apparatus of claim 23 including:

a cradle-shaped stool hingedly attached to said supporting member.

25. The apparaatus of claim 24 including:

at least one roller being attached to said stool, said roller capable of supporting said tuyere stock.

26. The apparatus of claim 24 including:

at least one first boring through said stool; and first connecting means pivotally connecting said first boring in said stool to said pipe bend portion of said tuyere stock.

27. The apparatus of claim 24 including:

at least one second boring through said stool, said second boring being capable of effecting a connection to said supporting member by a second connecting means.

28. The apparatus of claim 23 wherein:

said supporting member is removably attached to said end portion by a cotter pin connection system.

29. A tuyere stock removal apparatus for use in conjunction with a blast furnace having a hot air, closed circuit pipe line around the bosh, the tuyere stock comprising at least a blast nozzle, a pipe bend and a slanting down pipe, the removal apparatus including:

carriage means;

suspension means for suspending said carriage means along first rails, said first rails having a path corresponding to said pipe line;

first driving means for moving said carriage means along said rollers;

pivotal support means suspended from said carriage means, said pivotal support means capable of pivoting about a vertical axis;

second driving means capable of moving said pivotal support about said vertical axis;

support frame means being suspended from said pivotal support means;

first pivoting means connected between said support frame means and said pivotal support means whereby said support frame means is capable of pivoting about a horizontal axis;

mounting carriage means attached to said support frame means, said mounting carriage being capable of horizontal displacement;

third driving means for moving said mounting carriage means;

extension arm means attached to said mounting carriage means, said extension arm having an end portion being, said end portion being capable of receiving removal tool means; and an adaptor means, said adpator means including;

a longitudinally adjustable strut hingedly connected at a first end to said pivotal support means;

a bearing and support arm, a first end of said bearing and support arm hingedly connected to a second end of said strut means, said first end of said bearing and support arm connected also to said slanting down pipe; and an operating lever, a first end of said operating lever connected to said pivotal support means, a second end of said operating lever hingedly connected to a second end of said bearing and support arm.

30. The apparatus of claim 29 including:

at least one extension being attached to said bearing and support arm, said extension being provided with supporting blades, said supporting blades connected to said down pipe.

31. The apparatus of claim 29 wherein:

said operating lever is a double armed lever having first and second arms.

32. The apparatus of claim 31 including:

an overhanging arm, said overhanging arm being rigidly connected to said upper portion of said supporting frame;

said first arm of said operating lever being hingedly connected to said overhanging arm thereby defining a fulcrum;

said second arm of said operating lever being hingedly connected to said bearing and support arm.

33. The apparatus of claim 32 including:

a hydraulic cylinder having a piston rod, said hydraulic cylinder being hingedly connected to said supporting frame, said piston rod being hingedly connected to said second arm of said operating lever.

* * * * *